US005195610A

United States Patent [19]

Chang

[11] Patent Number: 5,195,610

[45] Date of Patent: Mar. 23, 1993

[54] BIDIRECTIONALLY FOLDABLE STEP LADDER

[76] Inventor: Wan Li Chang, No. 66, Lane 142, Sec. 1, Yung An Nan Rd., Lu Chou Hsiang, Taipei Hsien, Taiwan

[21] Appl. No.: 878,237

[22] Filed: May 4, 1992

[51] Int. Cl.[5] ..... E06C 1/00

[52] U.S. Cl. ..... 182/156; 182/159; 182/160

[58] Field of Search ..... 182/156, 159, 160, 157, 182/152

[56] References Cited

U.S. PATENT DOCUMENTS

| | | | |
|---|---|---|---|
| 958,732 | 5/1900 | Dennis | 182/160 |
| 1,054,108 | 2/1913 | Garraway | 182/160 |
| 1,371,125 | 3/1921 | Speckman, Jr. | 182/160 |
| 3,084,760 | 4/1963 | Lamberti | 182/160 |
| 4,560,030 | 12/1985 | Macelli | 182/160 X |
| 4,842,099 | 6/1989 | Collet et al. | 182/160 |

FOREIGN PATENT DOCUMENTS

| | | | |
|---|---|---|---|
| 1371237 | 10/1974 | United Kingdom | 182/159 |

*Primary Examiner*—Blair M. Johnson

*Attorney, Agent, or Firm*—Wegner, Cantor, Mueller & Player

[57] ABSTRACT

A step ladder which folds with respect to a width and a depth thereof. A set of unidirectionally foldable steps is pivotally attached between a pair of side rails, and an extendible cross-bracing assembly is disposed between another pair of side rails. Foldable spreaders are pivotally attached between opposing side rails. Each step has two halves, and a brace is pivotally attached to each half. A translation assembly is disposed in each side rail to which each brace is attached. When the ladder is folded with respect to its width, the steps fold upward, drawing the braces upward by means of the translation assembly. When the ladder is folded with respect to its depth, the spreaders are folded, resulting in a completely folded ladder with the steps and the braces substantially contained within the side rails. A locking assembly is disposed between the side rails for preventing the ladder from folding.

5 Claims, 9 Drawing Sheets

BIDIRECTIONALLY FOLDABLE STEP LADDER

BACKGROUND OF THE INVENTION

The present invention relates to a foldable step ladder and, more particularly, to a step ladder which folds in two directions.

The purpose of folding step ladders is to provide a ladder which is easy to store and transport. Conventional folding step ladders generally have a plurality of rigid steps positioned between two pairs of side rails. A foldable spreader is pivotally attached to opposing side rails so that the step ladder may be folded for more convenient storage and transportation. Although these types of step ladders fold, for all practical purposes, in half with respect to their depth, they still occupy considerable storage space in terms of their width. This storage space is considerably valuable when considered as inventory and transportation space.

Also, conventional ladders often have means for locking the ladders in an unfolded position. These means are often deployed on the spreaders and are elementary in design and do not insure that the ladder will not fold accidentally.

In an attempt to solve the above, as well as other, deficiency, the inventor of the present invention developed a bidirectionally foldable step ladder, which is now a pending U.S. patent application, Ser. No. 07/822,862, which was filed on Jan. 21, 1992. The inventor has further advanced the art of step ladders with the present invention for a step ladder which is foldable in two directions so as to minimize storage space therefor and which has means for locking the ladder in an unfolded position which increases the safety thereof.

SUMMARY OF THE INVENTION

The present invention provides a step ladder which is foldable in two directions: a first direction which folds the step ladder with respect to depth and a second direction which folds the step ladder with respect to width, thereby resulting in a folded position which minimizes the amount storage space. The present invention employs means which retain the step ladder in the folded position and means which prevent the step ladder from being folded as a safety device.

The present invention has two pairs of side rails with a pair of foldable spreaders pivotally attached therebetween. One set of foldable steps in plurality are respectively pivotally attached in a spaced relationship between one pair of side rails. Bracing means are pivotally attached to the steps to provide support thereto. Translation means are disposed in each side rail which allow the bracing means to move upward as the steps pivot. A extendible cross-bracing means is disposed between the other set of side rails.

One set of side rails are respectively received in the other set when in a folded position. Also, when in the folded position, the steps, the bracing means, and the extendible cross-bracing means are substantially contained within the side rails, yielding in streamlined storage.

For a better understanding of the present invention, its objects and advantages, reference should be made to the following description matter and accompanying drawings.

DETAILED DESCRIPTION OF THE PREFERRED EMBODIMENTS

Figure 1:
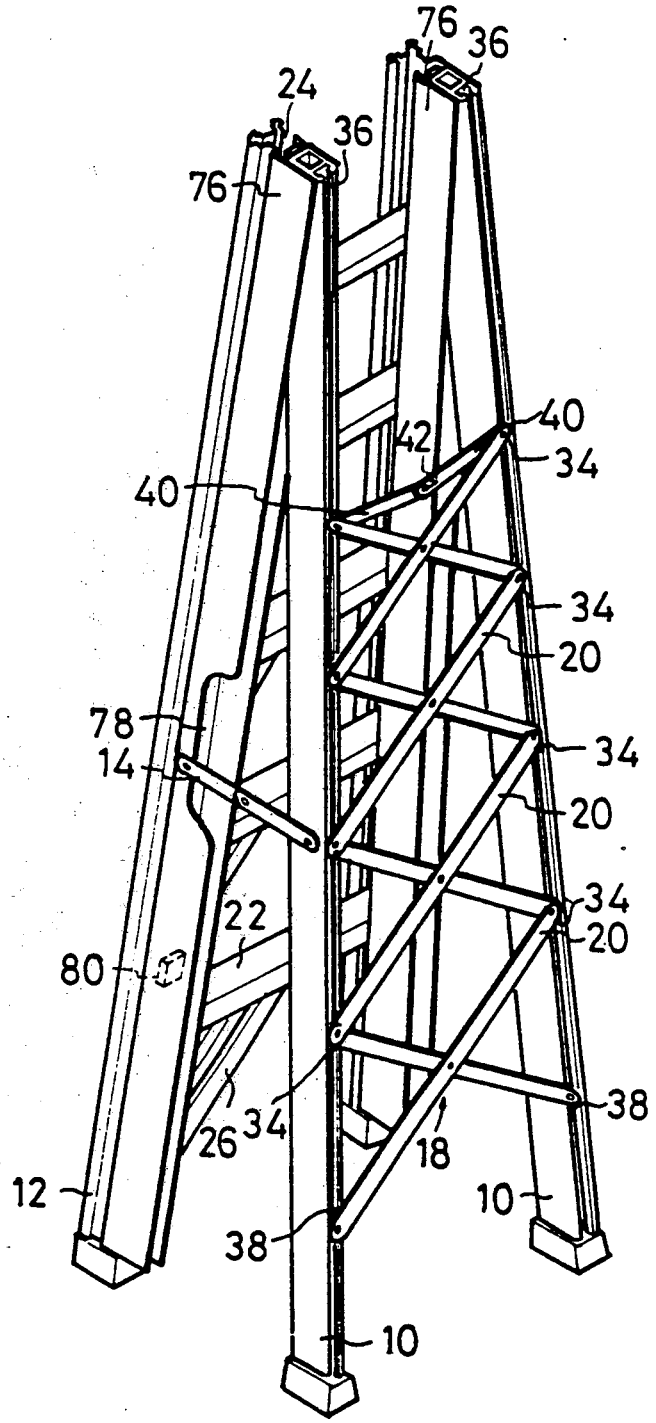
FIG. 1 is a perspective view of a bidirectionally foldable step ladder shown in a preferred embodiment in accordance with the present invention, illustrating an unfolded position and highlighting an extendible cross-bracing means thereof.
Figure 2:
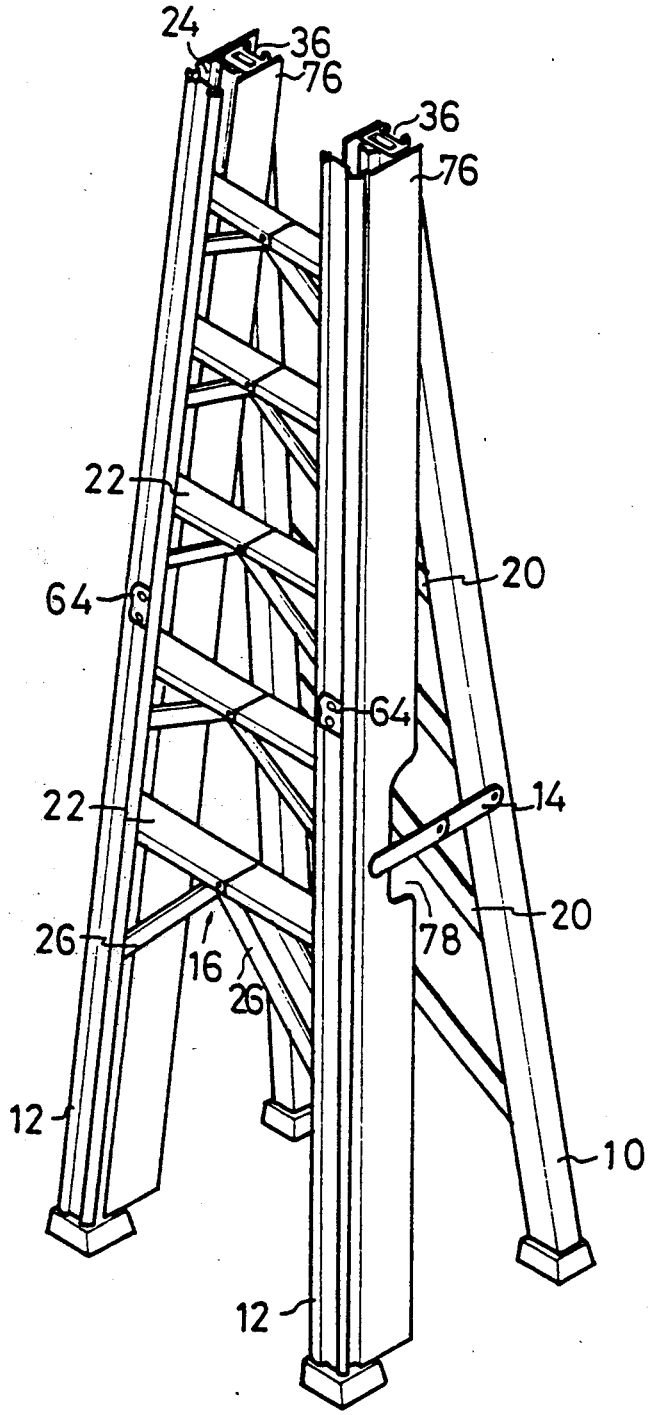
FIG. 2 is a view similar to FIG. 1, highlighting foldable steps thereof.

Referring to the drawings, particularly to FIGS. 1 and 2, a bidirectionally foldable step ladder is shown in a preferred embodiment in accordance with the present invention and generally comprises two sets of side rails with a plurality of foldable steps and an extendible cross-bracing means respectively disposed therebetween.

More specifically, a first pair of like side rails 10 and a second pair of like side rails 12 are pivotally attached at 10 top ends thereof and have a pair of pivotal spreaders 14 respectively pivotally attached between opposing side rails 10 and 12 by suitable means such as rivets, nuts and bolts, or the like. A plurality of foldable steps 16 are pivotally disposed between the second side rails 12. An extendible cross-bracing means 18 is pivotally disposed between the first side rails 10 and generally comprises a plurality of cross braces 20.

Figure 3:
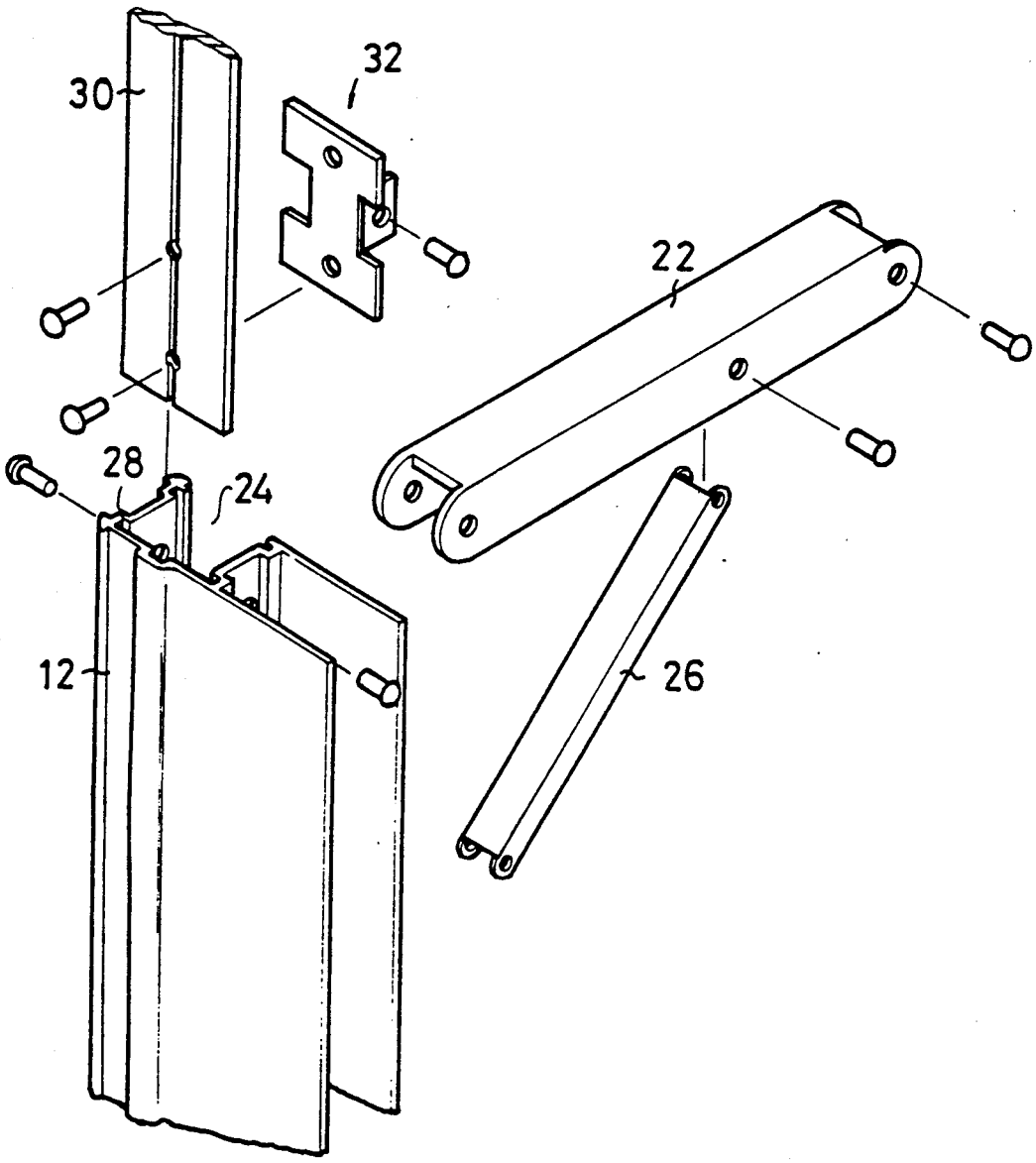
FIG. 3 is an exploded view of bracing means and translation means, in relation to a foldable step of the present invention.

Further referencing FIG. 3, each foldable step 16 comprises two substantially identical half steps 22 having an upper stepping surface and a pair of lower parallel rails. Each half step 22 is pivotally attached to a respective second side rail 12 and to a corresponding half step 22 thereof by suitable means such as rivets as shown. For these pivotal attachments, the second side rails 12 each have a substantially U-shaped channel 24 formed therein so that the half steps 22 are receivable therein. Furthermore, the lower rails of opposing half steps 22 are offset from each other, as best seen in FIG. 1, such that one of the opposing half steps 22 is receivable in the other.

Figure 4A:
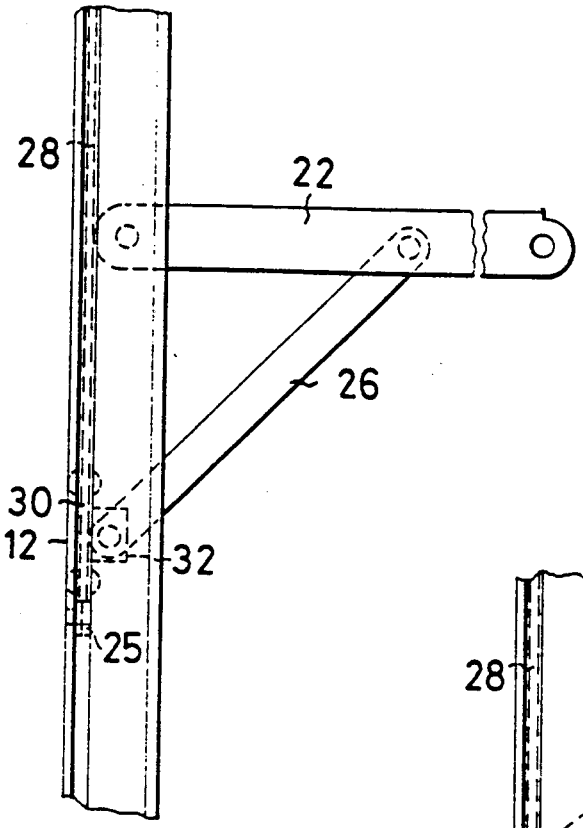
FIG. 4A is a plan view of the structure of FIG. 3, showing the lowermost foldable step in an unfolded position.
Figure 4B:
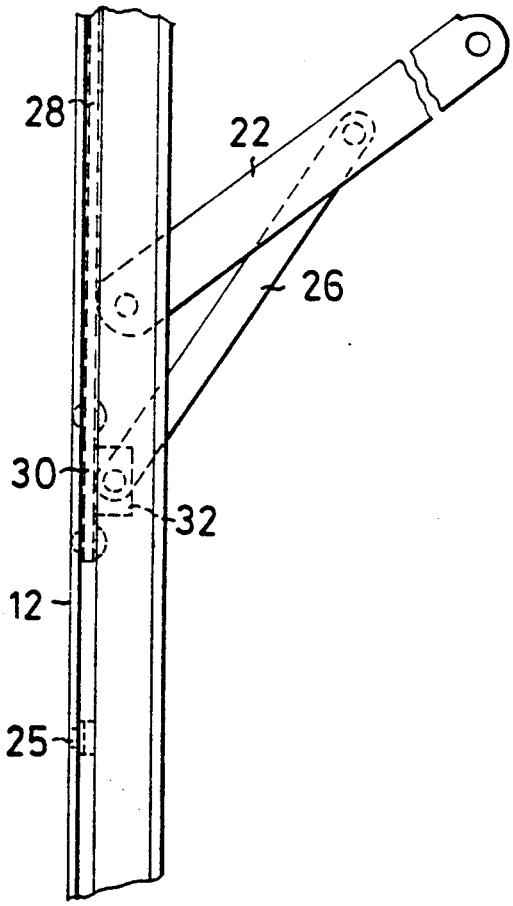
FIG. 4B is a view similar to FIG. 4A, showing a folding position.

As shown in FIG. 4A, a stop 25 is fixed in each second side rail 12 at a position which prevents the plate 30 from moving further downward than that which allows the foldable step 16 from maintaining a horizontal position when unfolded. FIG. 4B illustrates the action between the bracing means 26 and the translation means when the step ladder is in a folding position.

With continued reference to FIGS. 1 to 3, bracing means 26 are pivotally attached by suitable means such as rivets to each half step 22 between lower rails thereof and to a respective translation means received in the U-shaped channel 24 of each second side rail 12. Each translation means generally comprises a longitudinal slot 28 being formed in the second side rail 12, a plate 30 being slidably received in the slot 28, and a bracket 32 being fixed to the plate 28 and pivotally attached to the bracing means 26. For the bracing means 26 to rigidly support the foldable steps 16, the plate 30 is in a lowermost position in the slot 28 such that further downward movement thereof is prevented which prevents the steps 16 from pivoting below the horizontal positions thereof shown in FIGS. 1 and 2.

Figure 5:
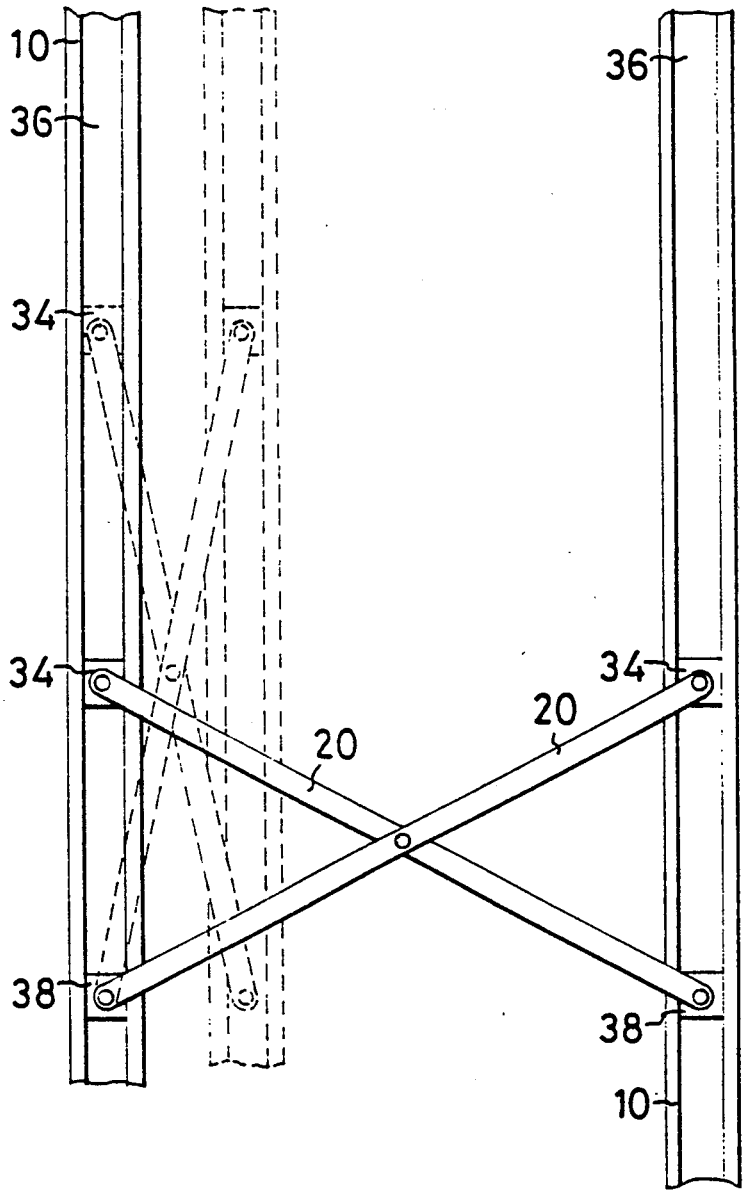
FIG. 5 is a plan view of a pair of cross braces of the extendible cross-bracing means.

Now with further reference to FIG. 5, the extendible cross-bracing means further comprises tracking elements 34 pivotally attached to ends of each cross brace 20 and slidably received in a respective track 36 formed in each first side rail 10. As can be seen, the cross braces 20 form pairs of cross braces pivotally attached at centers thereof with the tracking elements 34 linking adjacent pairs of cross braces. It can be realized that the pair of cross braces shown in FIG. 4 is a lowermost pair such that a fixed track element 38 is fixed in the track 36, such that when the first side rails 10 are drawn together, as shown in phantom line, the fixed track element 38 remains stationary while the tracking elements 34 are forced to slide upwards in the tracks 36.

Figure 6:
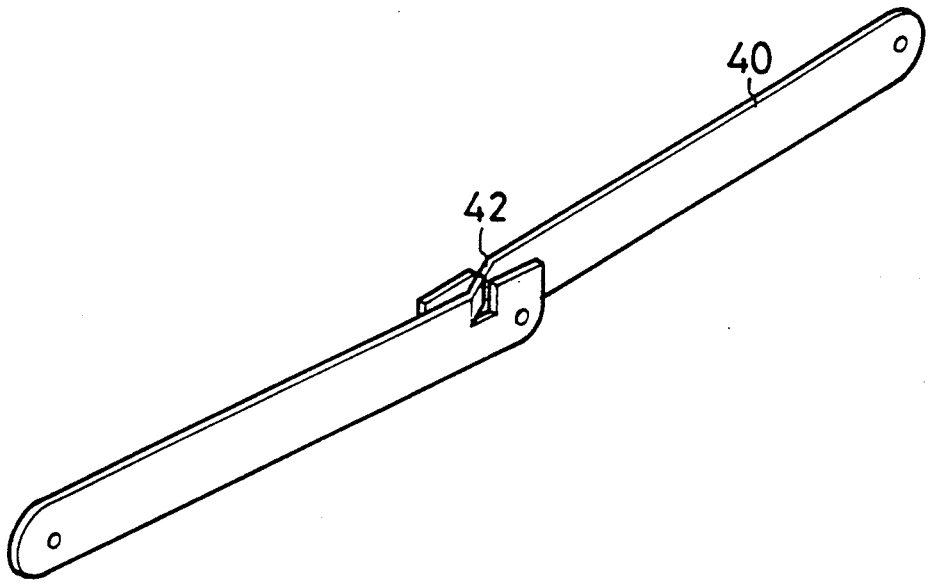
FIG. 6 is a perspective view of a pair of lock braces in accordance with the present invention.

With specific reference to FIGS. 1 and 6, pivotally attached to an uppermost pair of cross braces 20 is a pair of lock braces 40 which are pivotally attached together. Near a center of each lock brace 40 is formed a catch 42. An overall length of the pair of lock braces 40 is slightly greater than the distance between the first side rails when unfolded, such that the lock braces 40 have to be urged downward through a horizontal axis of the pair, the catches 42 limiting any further downward movement. This arrangement allows the pair of lock braces 40 to act as a lock, such that the lock braces 40 need to be urged upward to draw the first side rails 10 together to fold the step ladder.

Figure 7:
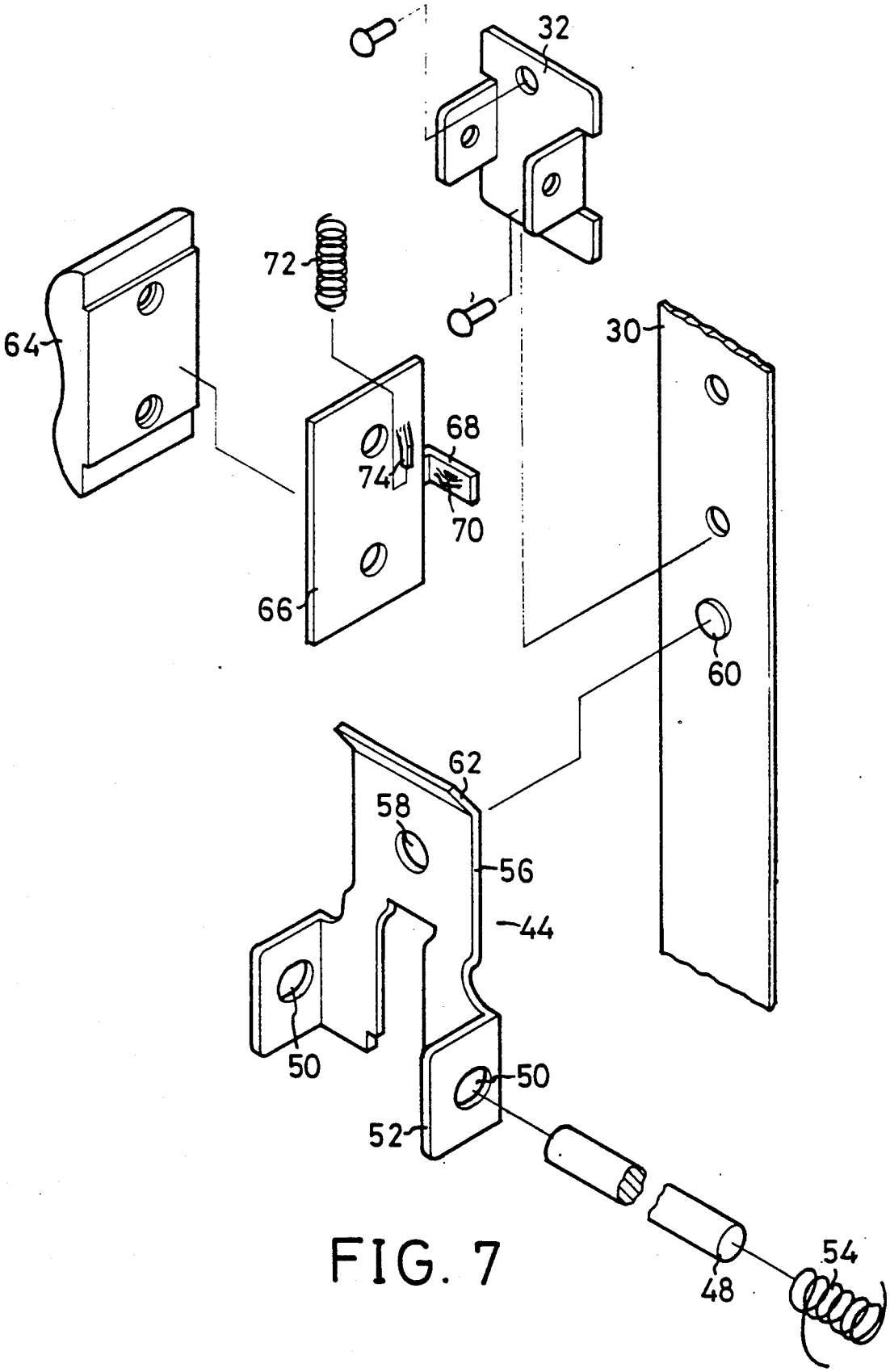
FIG. 7 is an exploded view of locking means in accordance with the present invention.

Specifically referencing FIG. 7 and generally referencing FIGS. 1 to 3, the bidirectionally foldable step ladder in accordance with the present invention further preferably comprises locking means for locking the step ladder in an unfolded position. A locking means is disposed in each second side rail 12 and generally comprises a latching element 44 and a releasing means 46.

The latching element 44 is pivotally attached to the second side rail 12 within the U-shaped channel 24 thereof by means of an axle 48 passing through holes 50 formed in a pair of L-shaped brackets 52 and being fixed to walls of the U-shaped channel 24. A spring 54 urges the latching element 44 around an axis of rotation defined by the axle 48, such that a contact plate 56 thereof contacts the plate 30 in a flush manner. A hole 58 is formed in the contact plate 56 in which a protrusion 60 disposed on the plate 30 is receivable therein. An angled lip 62 is formed on a top edge of the contact plate 56, angling away from the plate 30, Which Will be discussed later.

With continued specific reference to FIG. 7, the releasing means 46 generally comprises a handle portion 64 and a lever element 66. The handle portion 64 is disposed on the outside of the second side rail 12 and is fixed by suitable means to the lever element 66 with a wall of the U-shaped channel 24 therebetween. The wall of the U-shaped channel 24 has a longitudinal slot (not shown) formed therein, such that the releasing means 46 is longitudinally slidable on the second side rail 12. The lever element 66 has an arm 68 perpendicularly projecting therefrom which has a protrusion 70 formed thereon. A spring 72 is fixed to the lever element 66 by means of a hook 74 formed thereon and to the second side rail 12, such that the releasing means 46 is constantly urged upwards in slot (not shown) of the U-shaped channel 24.

Figure 8C:
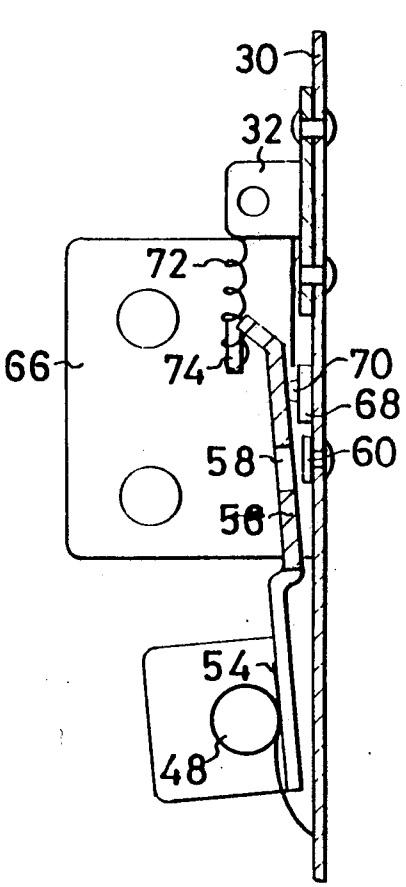
FIG. 8A, 8B, and 8C are cross-sectional view of the locking means, respectively showing an unfolding position, an unfolded position, and a folding position.
Figure 8B:
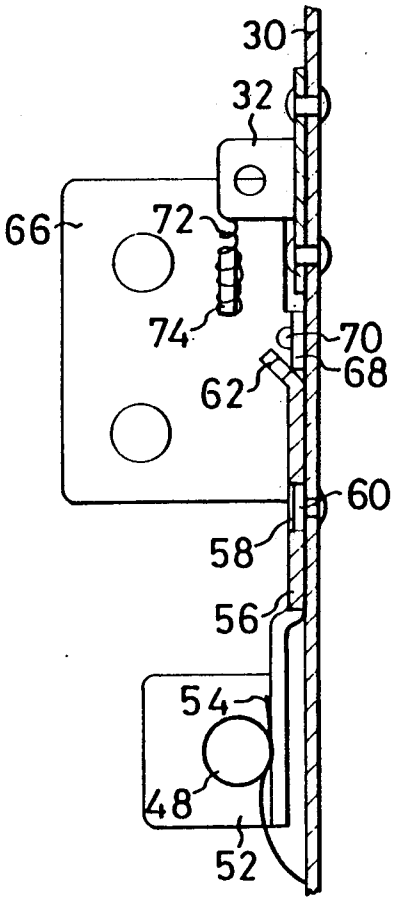
Figure 8A:
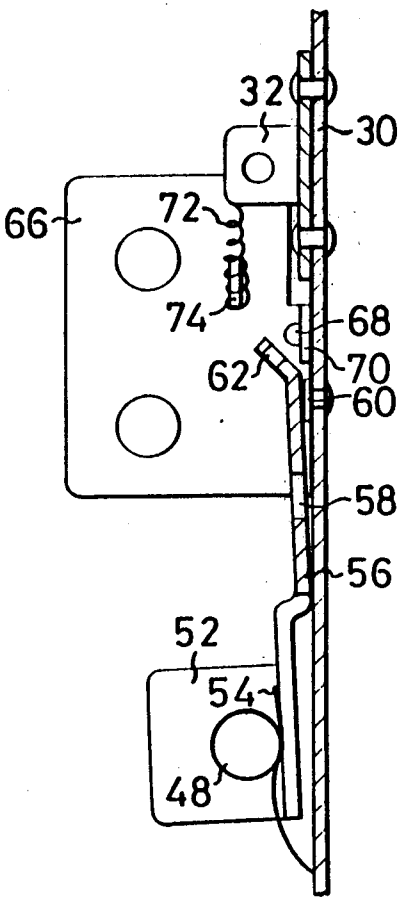

With further reference to FIGS. 8A, 8B, and 8C, three different stages of the locking means are shown: unfolding, unfolded, and folding, respectively. As can be seen by FIG. 8A, as the plate 30 slides downward in the slot 28 (see FIG. 3), the protuberance 60 contacts the angled lip 62, thereby urging the contact plate 56 outward, the latching element 44 pivoting around the axis of rotation thereof. As can be seen, the contact plate 56 is offset from the L-shaped brackets 52 so as to allow the pivotal movement.

When the plate 30 has moved to a lowest position, i.e., the foldable steps 16 are horizontal, the protuberance 60 is received in the hole 58, and the contact plate 56 is again flush with the plate 30, as shown in FIG. 8B. From this position, the plate 30 is prevented from any movement such that the step ladder is unfolded and locked in the unfolded position.

When it is desired to fold the ladder, the handle portion 64 of each locking means is urged downward such that the protrusion 70 contacts the angled lip 62, thereby urging the contact plate 56 outward, as shown in FIG. 8C, in a similar manner as described above. When the protuberance 60 has cleared the hole 58, the plate 30 is able to slide upward so that the step ladder can be folded.

Figure 9:
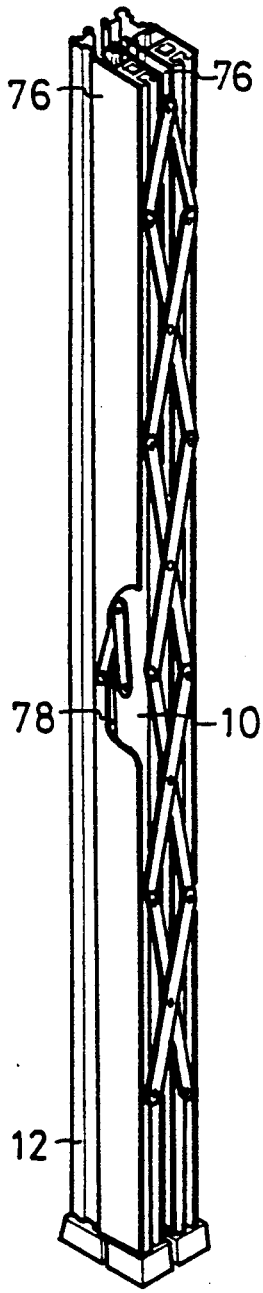
FIG. 9 is a perspective view of the step ladder in a folded position.

FIG. 9 illustrates the step ladder in the folded position. As can be seen, the first side rails 10 are received within the second side rails 12 between extension walls 76 thereof. A cutout portion 78 of each second side rail 12 allows the spreaders 14 to be folded completely. A block 80, which can be seen in phantom line in FIG. 1, is disposed in each second side rail 12 and maintains the first side rails 10 in a position which is flush with the outer edges of the extension walls 78.

Accordingly, it is to be understood that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

I claim:

1. A foldable step ladder comprising:

a first pair of like side rails and a second pair of like side rails, said first and said second side rails in opposition and pivotally attached at top portions thereof;

a pair of foldable spreaders each being pivotally attached between opposing said first and said second side rails;

extendable cross-bracing means being disposed between said first side rails, said cross-bracing means being pivotally and slidably attached to said first side rails;

a plurality of foldable steps being disposed in a spaced relationship between said second side rails, said steps being pivotally attached to said second side rails by suitable means, said steps being foldable in a single direction;

whereby said step ladder is foldable from an unfolded position with respect to a width thereof by pivoting said steps, drawing said second side rails together, and by extending said cross-bracing means, drawing said first side rails together, and is foldable with respect to a depth thereof by pivoting said spreaders, drawing said first and said second side rails together, thereby said step ladder is in a folded position;

locking means for locking said step ladder in said unfolded position, preventing said side rails from being drawn together;

bracing means pivotally attached to each said step for supporting said steps; and translation means disposed in each said second side rail for allowing said bracing means movement when said steps fold, said bracing means being pivotally attached to said translation means;

each said second side rail comprising a substantially U-shaped channel;

each said step comprising two half steps each having an upper stepping surface and a pair of lower parallel rails, said half steps being pivotally attached to each other at first ends thereof and to respective said side rails on an inside thereof and being receivable in said U-shape channels;

each said translation means comprising a longitudinal slot formed in said U-shaped channel, a plate slidably received in said slot, and a plurality of brackets fixed to said plate corresponding to said bracing means; and each said bracing means being pivotally attached to one said half step between said lower rails thereof and to one said bracket;

said plate being in a lowermost position in said slot such that further downward movement thereof is prevented which prevents said steps from pivoting below horizontal positions thereof; and said locking means being disposed on said second side rails preventing upward movement of said plate.

2. A foldable step ladder comprising a first pair of like side rails and a second pair of like side rails, said first and said second side rails in opposition and pivotally attached at top portions thereof;

a pair of foldable spreaders each being pivotally attached between opposing said first and said second side rails;

extendable cross-bracing means being disposed between said first side rails, said cross-bracing means being pivotally and slidably attached to said first side rails;

a plurality of foldable steps being disposed in a spaced relationship between said second side rails, said steps being pivotally attached to said second side rails by suitable means, said steps being foldable in a single direction;

whereby said step ladder is foldable from an unfolded position with respect to a width thereof by pivoting said steps, drawing said second side rails together, and by extending said cross-bracing means, drawing said first side rails together, and is foldable with respect to a depth thereof by pivoting said spreaders, drawing said first and said second side rails together, thereby said step ladder is in a folded position;

each said first side rail having a track longitudinally formed therein; and said cross-bracing means comprising a plurality of cross braces, pairs of said cross braces being pivotally attached at centers thereof; and a plurality of tracking elements being slidably receivable in said tracks; an end of each said cross brace being pivotally attached to one said tracking element, ends of adjacent said cross braces being attached to a same said tracking element; a lowermost pair of said cross braces having lower ends thereof pivotally attached to a fixed track element;

whereby said tracking elements slide in said tracks as said first side rails are drawn together, extending said cross-bracing means upward.

3. A foldable step ladder as claimed in claim 2, wherein said cross-bracing means further comprises a pair of lock brackets; said lock braces being pivotally attached to each other at first ends thereof and to respective uppermost said tracking elements at second ends thereof; each said lock brace having a catch formed near said first end thereof; an overall length of said pair of lock braces being slightly greater than a distance between said first side rails when in said unfolded position;

whereby said lock braces have to be urged downward through a horizontal axis thereof with said catches limiting further downward movement, and said lock brackets have to be urged upward to allow said first side rails to be drawn together.

4. A foldable step ladder as claimed in claim 1, wherein said U-shaped channel has a longitudinal slot formed therein, said plate has a protuberance formed thereon, and said locking means comprises a latching element and releasing means;

said latching element comprising a pair of L-shaped brackets each having a hole formed therethrough, an axle being received in said holes and in said U-shaped channel for pivotally attaching to said latching element to said second side rail, a contact plate contacting said plate in a flush manner and having a hole formed therein, an angled lip being formed on a top of said contact plate and angling away from said plate, and a spring being disposed around said axle for urging said contact plate toward said plate;

said releasing means generally comprising a handle portion being disposed on an outside of said second side rail, a lever element being disposed on an inside of said second side rail and fixed to said lever element through said slot of said U-shaped channel and having an arm perpendicularly projecting therefrom and having a protrusion formed thereon, and a spring being fixed to said lever element and to said second side rail and for urging said releasing means upward in said slot of said U-shaped channel;

whereby when said plate slides downward in said slot, said protuberance contacts said angled lip, thereby urging said contact plate outward, said latching element pivoting around said axle; when said plate has moved to said lowermost position, said protuberance is received in said hole of said contact plate, said contact plate is flush with said plate, thereby preventing said plate from moving and locking said step ladder in said unfolded position; and when it is desired to fold said step ladder, said handle portion is urged downward, said protrusion contacts said angled lip, thereby urging said contact plate outward, said protuberance clearly said hole of said contact plate, thereby allowing said plate to move upward.

5. A foldable ladder as claimed in claim 1, wherein each said second rails comprise a pair of extension walls for receiving said first side rails therein when said step ladder is in said folded position, each said extension wall having a cutout portion for allowing said spreaders to be folded completely.

* * * * *